US005992182A

United States Patent [19]

Lonati et al.

[11] Patent Number: 5,992,182

[45] Date of Patent: Nov. 30, 1999

[54] METHOD FOR LADDERPROOFING THE LAST ROW OF A KNITTED ITEM

[75] Inventors: Francesco Lonati; Ettore Lonati; Tiberio Lonati; Fausto Lonati, all of Brescia, Italy

[73] Assignee: Matec S.p.A., Scandicci, Italy

[21] Appl. No.: 08/936,426

[22] Filed: Sep. 24, 1997

[30] Foreign Application Priority Data

Oct. 23, 1996 [IT] Italy ..... B096A0534

[51] Int. Cl.[6] ..... D04B 9/24

[52] U.S. Cl. ..... 66/41; 66/172 R

[58] Field of Search ..... 66/169 R, 170, 66/171, 172 R, 173, 172 E, 8, 40, 41

[56] References Cited

U.S. PATENT DOCUMENTS

| | | | |
|---|---|---|---|
| 1,045,621 | 11/1912 | Scott | 66/172 R |
| 1,992,225 | 2/1935 | Lieberknecht . | |
| 2,067,486 | 1/1937 | Gastrich | 66/172 R |
| 2,257,718 | 9/1941 | Smith, Jr. | 66/172 E |
| 3,841,115 | 10/1974 | Kejnovsky et al. | 66/172 R |
| 3,882,696 | 5/1975 | Jeffcoat et al. . | |
| 4,326,393 | 4/1982 | Dunlap | 66/172 E |
| 4,750,339 | 6/1988 | Simpson, Jr. et al. | 66/172 R |

FOREIGN PATENT DOCUMENTS

| | | | |
|---|---|---|---|
| 166 376 | 12/1902 | Germany . | |
| 1588549 | 4/1981 | United Kingdom | 66/172 E |
| 2114170 | 8/1983 | United Kingdom | 66/172 R |
| 2140469 | 11/1984 | United Kingdom | 66/172 R |

*Primary Examiner*—John J. Calvert
*Assistant Examiner*—Larry D. Worrell, Jr.
*Attorney, Agent, or Firm*—Guido Modiano; Albert Josif

[57] ABSTRACT

A method for ladderproofing the last row of a knitted item consisting in that, upon execution of the last row of the item, the interstitch portions, i.e., the portions of the thread or threads that join two contiguous loops of knitting, are produced with an increased length, forming additional loops which are alternated with the loops of the last row of knitting. Preferably, each one of the loops of the last row is knit in with a contiguous additional loop, further reinforcing the ladderproofing of the last row of the item.

10 Claims, 9 Drawing Sheets

METHOD FOR LADDERPROOFING THE LAST ROW OF A KNITTED ITEM

BACKGROUND OF THE INVENTION

The present invention relates to a method for ladderproofing the last row of a knitted item.

Items knitted with conventional knitting machines or stocking machines must be sewn or looped at the end of manufacture in order to prevent the last formed row of knitting from laddering, also affecting the previous rows in its laddering.

Sewing or looping after manufacture of the knitted items considerably affects the production costs of said items.

In some cases, as when closing the toe of stockings knitted starting from the top or cuff of the leg, said sewing is also required in order to complete the item, but frequently the sewing or looping operations have the only purpose of ladderproofing the item.

SUMMARY OF THE INVENTION

A principal aim of the present invention is to solve the above problem by providing a method for ladderproofing the last row of a knitted item, thus avoiding the need to perform subsequent sewing or looping operations.

Within the scope of this aim, an object of the present invention is to provide a method which can be performed simply with conventional knitting machines or stocking machines.

Another object of the invention is to provide a method which allows to obtain an item in which the end region of the knitting is performed in an aesthetically acceptable manner.

This aim, these objects and others which will become apparent hereinafter are achieved by a method for ladderproofing the last row of a knitted item, characterized in that in the execution of the last row of the item, the interstitch portions, i.e., the portions of the thread or threads that join two initially contiguous loops of knitting, are produced with an increased length, forming additional loops which are alternated with the loops of the last row of knitting.

According to a particularly advantageous aspect of the invention, each one of the loops of the last row is then preferably knitted in with a contiguous additional loop of knitting.

BRIEF DESCRIPTION OF THE DRAWINGS

Further characteristics and advantages of the present invention will become apparent from the following detailed description of a preferred but not exclusive embodiment of the method according to the invention, illustrated only by way of non-limitative example in the accompanying drawings, wherein.

DESCRIPTION OF THE PREFERRED EMBODIMENTS

Figure 1:
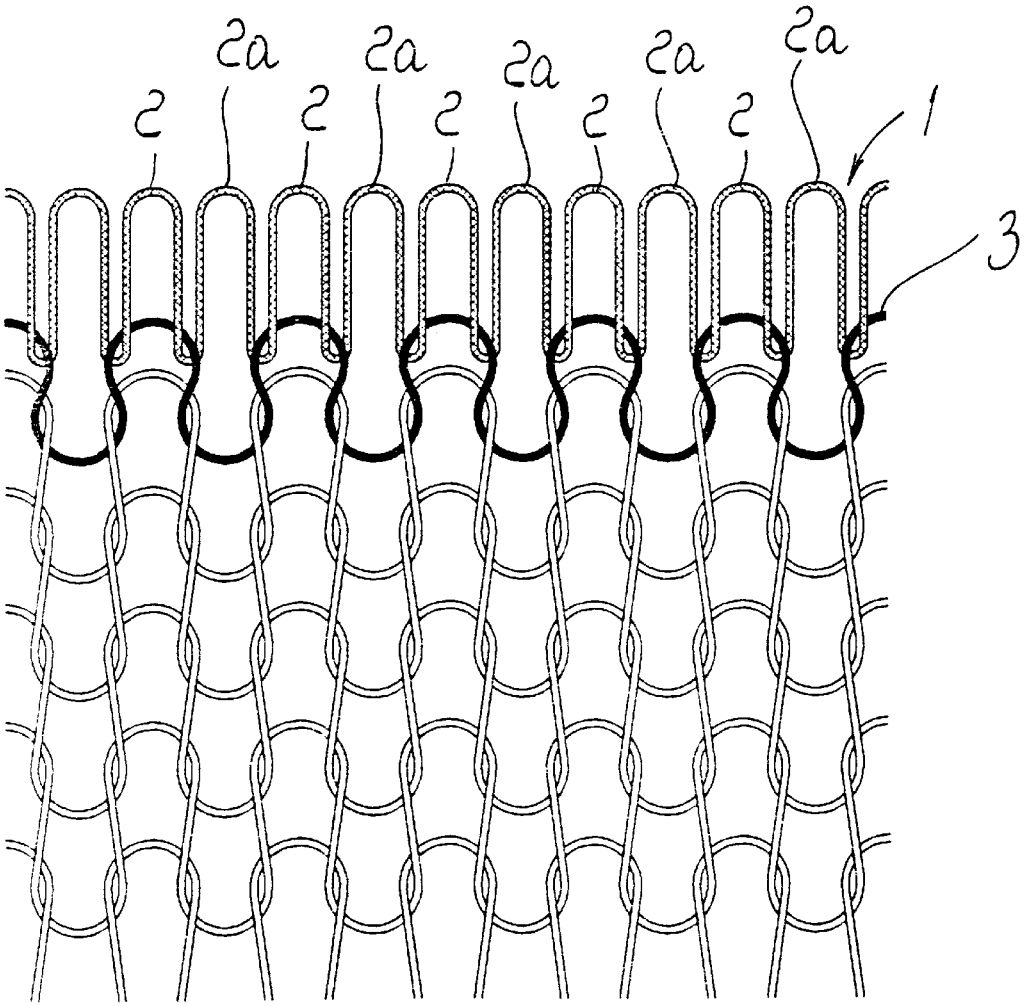
FIG. 1 is a view of an end portion of a knitted item produced with the method according to the invention.
Figure 2:
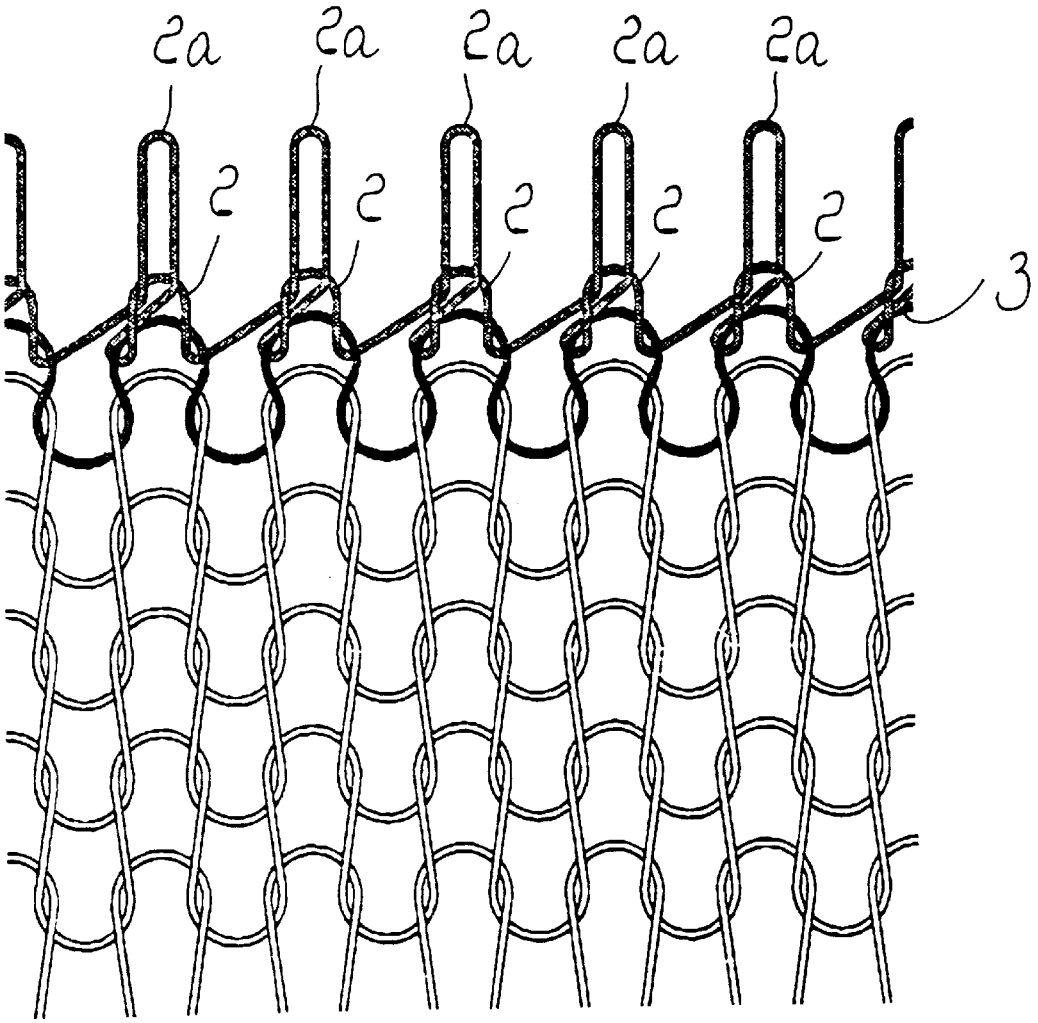
FIG. 2 is a view of the end portion of a knitted item produced with the method according to the invention and with an additional knitting step to reinforce the ladderproofing of the last row of the item.

With particular reference to FIGS. 1 and 2, the method according to the invention substantially consists in providing the last row of knitting 1 of an item by producing the interstitch portions, i.e., the portions of the thread or threads used in forming the last row 1 which join two initially contiguous loops 2 of knitting, so that they are longer, so as to form additional loops 2*a* which are alternated with the loops 2 of the last row of knitting 1.

Said increased length can be provided, for example in the manufacture of a tubular item by means of a circular knitting machine or stocking machine with a needle cylinder and a circular plate, by using the hooks arranged in the circular plate, which are arranged between the needles of the needle cylinder and form a raised supporting surface for the interstitch portions, as will become apparent hereinafter.

Conveniently, the next-to-last row of knitting 3, shown as a solid black line in the figure, is provided with one or more elastic threads which are pretensioned during feeding to the machine, so that at the end of the knitting process the last-but-one row of knitting 3 clamps the loops 2 and the additional loops 2*a* of the last row 1, effectively avoiding the sliding of the thread or threads that constitute the last row 1 even if traction is applied to said thread.

A similar effect can be achieved by forming the next-to-last row of knitting 3 with loops which are shorter than the loops of the last row of knitting. This effect can be easily obtained by varying the tightness of the knitting, in a manner known per se, by means of devices with which conventional knitting machines or hosiery-making machines are usually equipped.

Advantageously, in order to further increase the ladderproofing of the last row 1 of the item, each one of the loops 2 of the last row is knitted in with a contiguous additional loop 2*a*, as shown in particular in FIG. 2.

In this manner, one achieves a sort of knotting of the additional loops 2*a* together with the loops 2 which safely excludes any possibility of sliding and therefore of laddering of the loops of the last row 1.

FIGS. 3 to 6 illustrate, merely by way of non-limitative example, the operating sequence during the execution of the method according to the invention on a circular knitting machine or stocking machine provided with needles 10 supported by the needle cylinder and with hooks 11 supported by the circular plate that faces the needle cylinder in an upward region.

Figure 3:
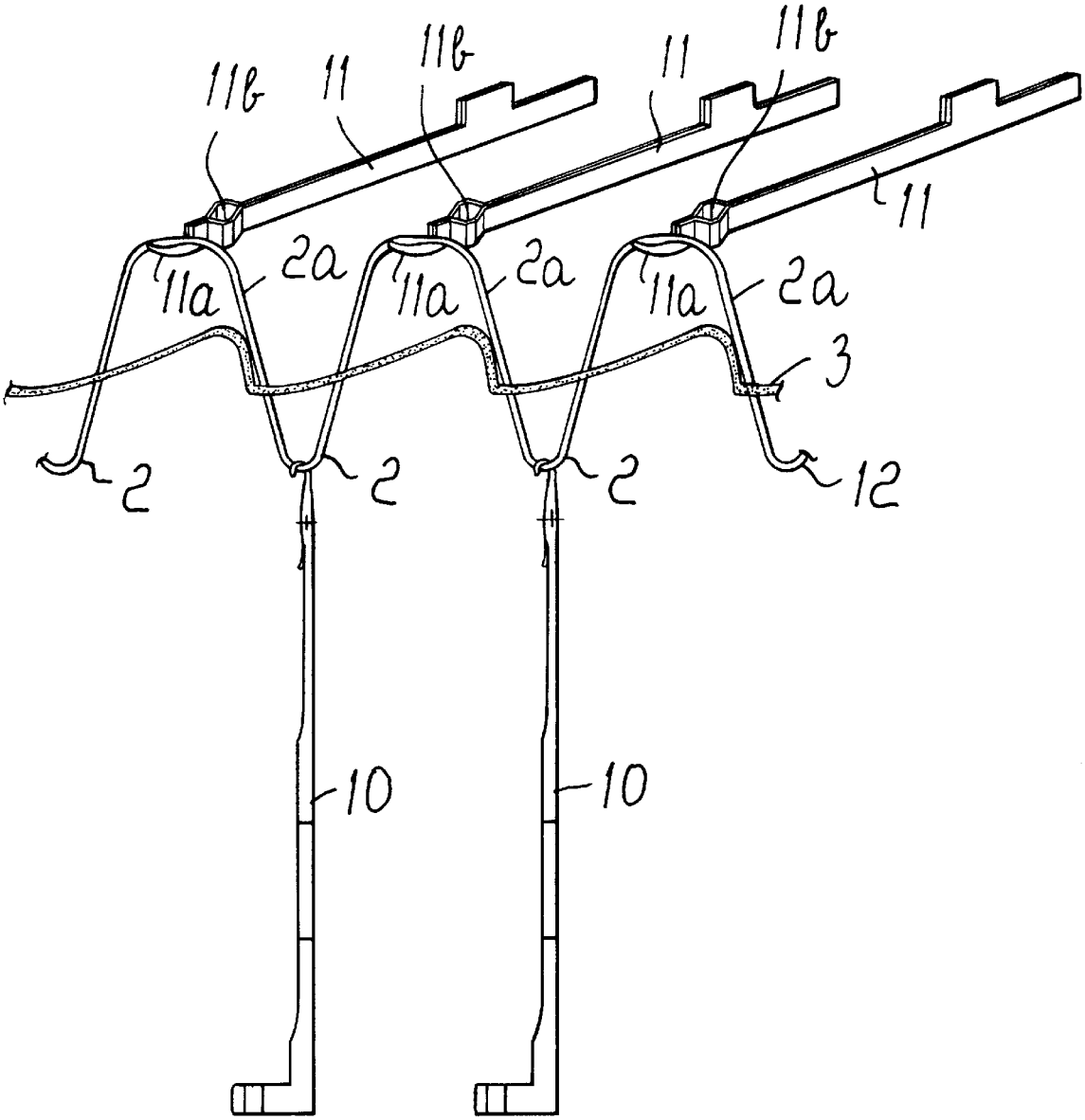
FIGS. 3 to 6 are schematic views of a possible embodiment of the method according to the invention on a knitting machine or hosiery-making machine provided with needles and hooks.

As shown in FIG. 3, the thread 12 for forming the last row 1 is deposited on the tip 11*a* of the hooks 11, each of which is arranged between two contiguous needles 10.

The thread 12 is taken by the needles 10, which form the loops 2 by dropping the loops of the next-to-last row 3, as shown in FIG. 3.

At this point, the item can be unloaded from the machine by disengaging the needles 10 and the hooks 11 respectively from the loops 2 and from the additional loops 2*a*, obtaining an item of the kind shown in FIG. 1.

Advantageously, as mentioned, the loops 2 can be knitted in with the additional loops 2*a* in order to further increase ladderproofing.

Figure 4:
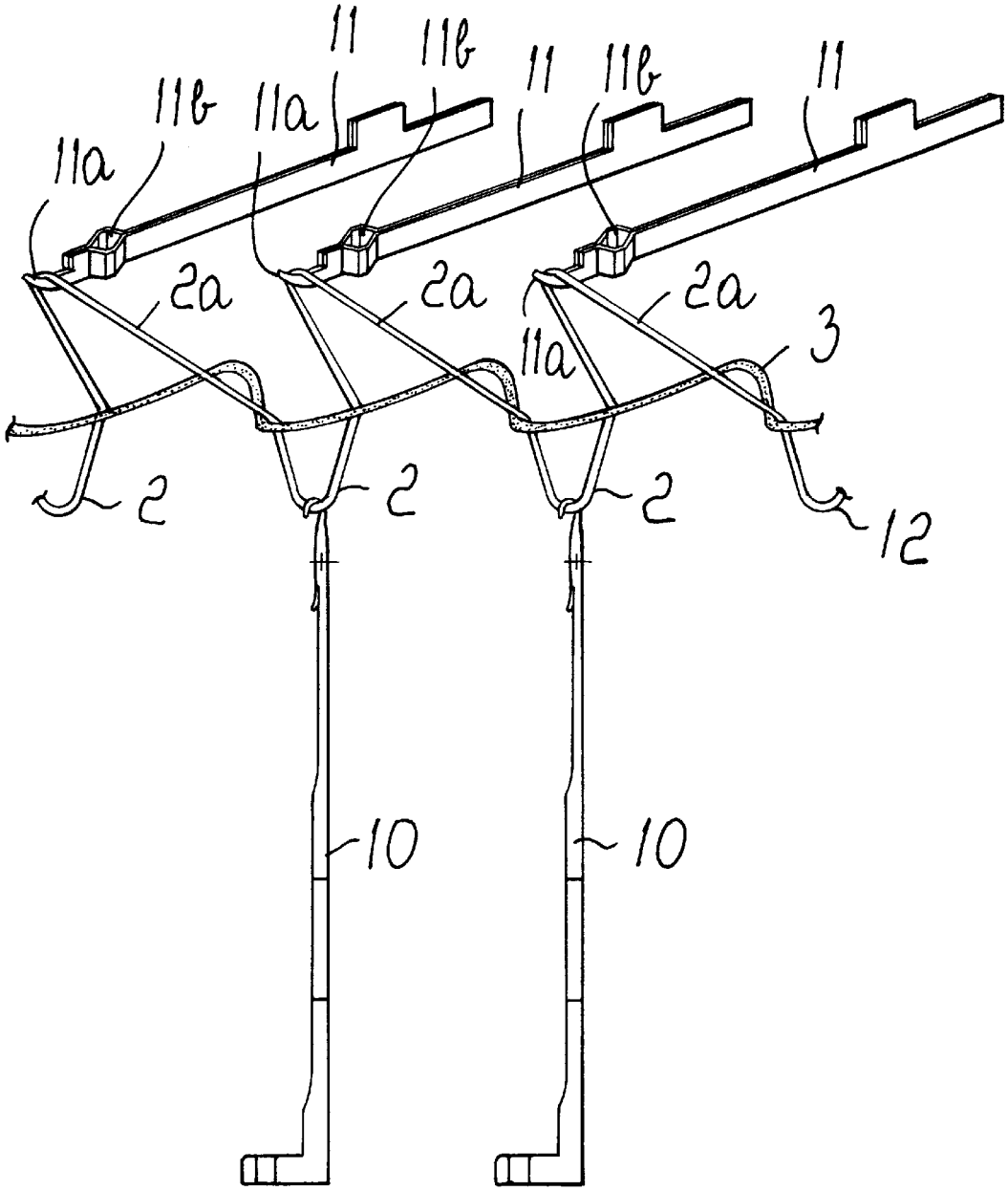

This is done, as shown in particular in FIG. 4, by offsetting the circular plate with respect to the needle cylinder, so as to place each hook 11 at each needle 10. Preferably, the hooks 11 have a double body, i.e., a body constituted by two mutually adjacent laminae which form between them, in a region of the longitudinal extension of the hook 11, a seat 11*b* through which a needle 10 can pass.

After the offsetting which places the hooks 11 at the needles 10, the hooks 11 are shifted longitudinally so as to move the seats 11*b* into alignment with the underlying needles 10.

Figure 5:
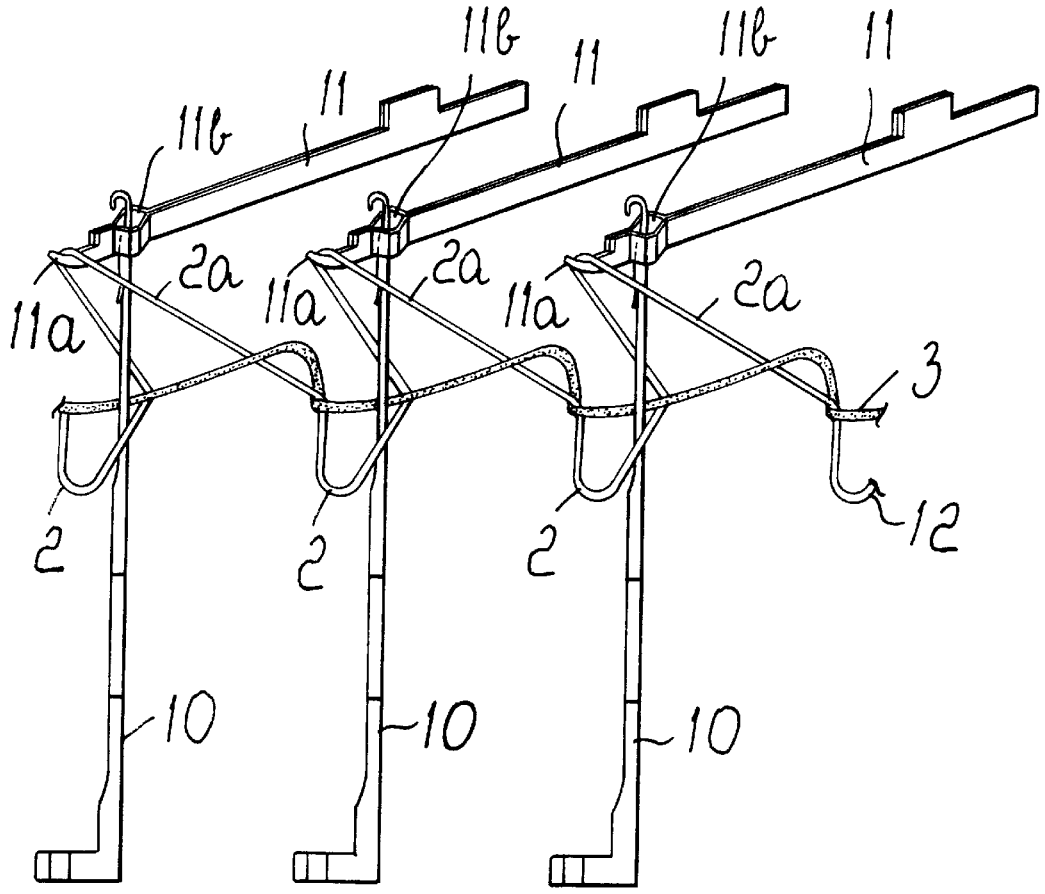

At this point, as shown in FIG. 5, the needles 10 are raised until their tip passes through the seat 11*b*. Then the hooks 11 are moved again with respect to the needles 10, so as to cause the protrusion of the needles 10 towards the tip 11*a* of the hooks 11, consequently making the tip of the needles engage the additional loops 2*a* held on the tip 11*a* of the hooks.

Figure 6:
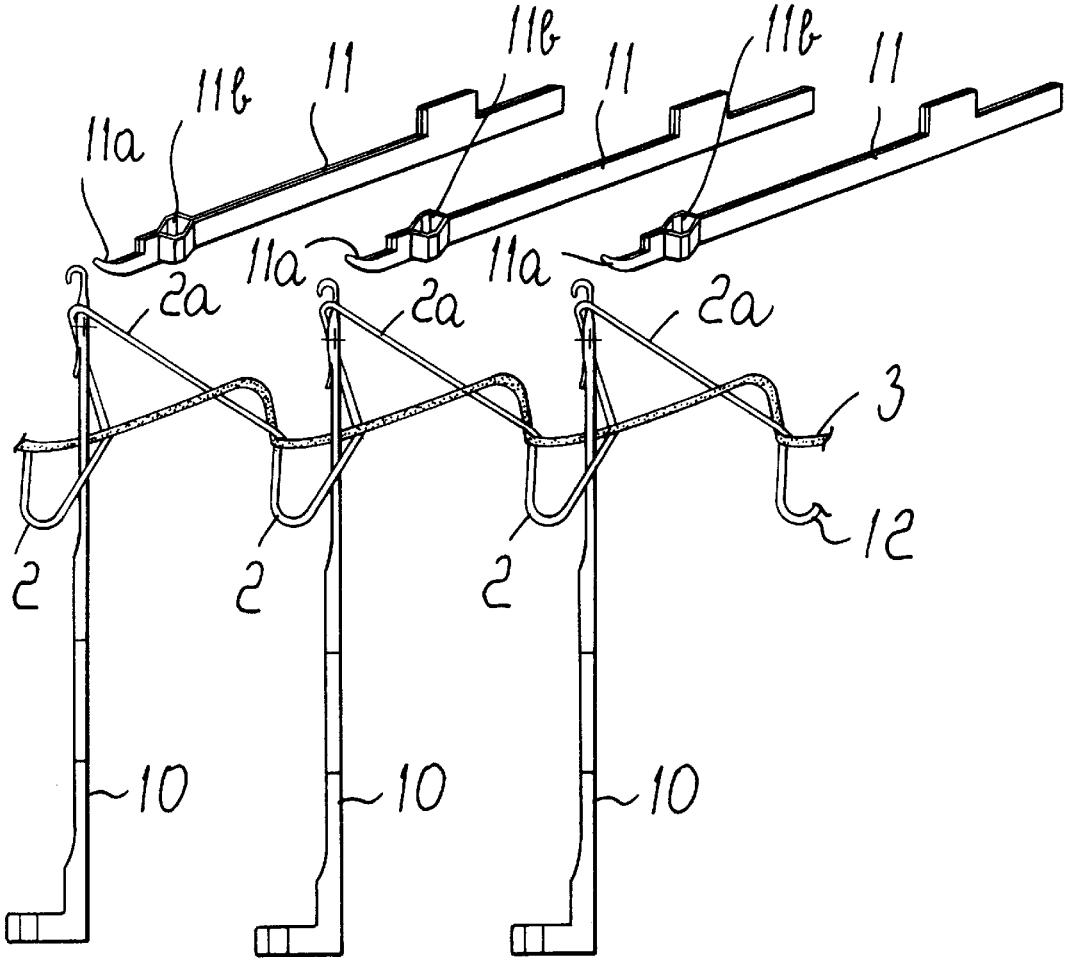

Once the additional loops 2*a* have been engaged by the tip of the needles 10, they are moved, as shown in FIG. 6, through the loops 2, which are thus knit in with the additional loops 2*a*. The item is then unloaded from the needles 10. In this manner the item illustrated in FIG. 2 is obtained.

Figure 7:
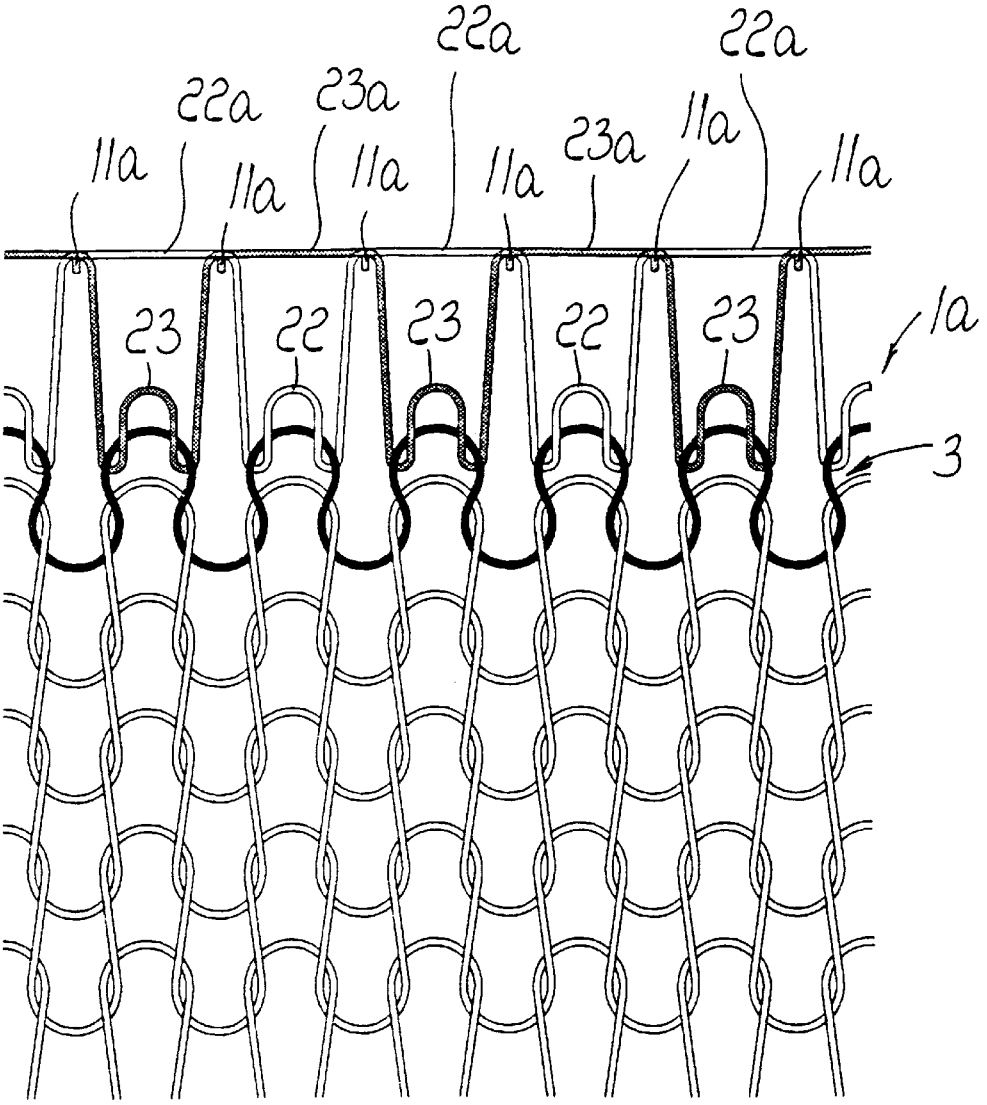
FIGS. 7 and 8 are views of the end portion of a knitted item produced according to a different embodiment of the method according to the invention, respectively during an intermediate step of the knitting and at the end of the knitting.
Figure 8:
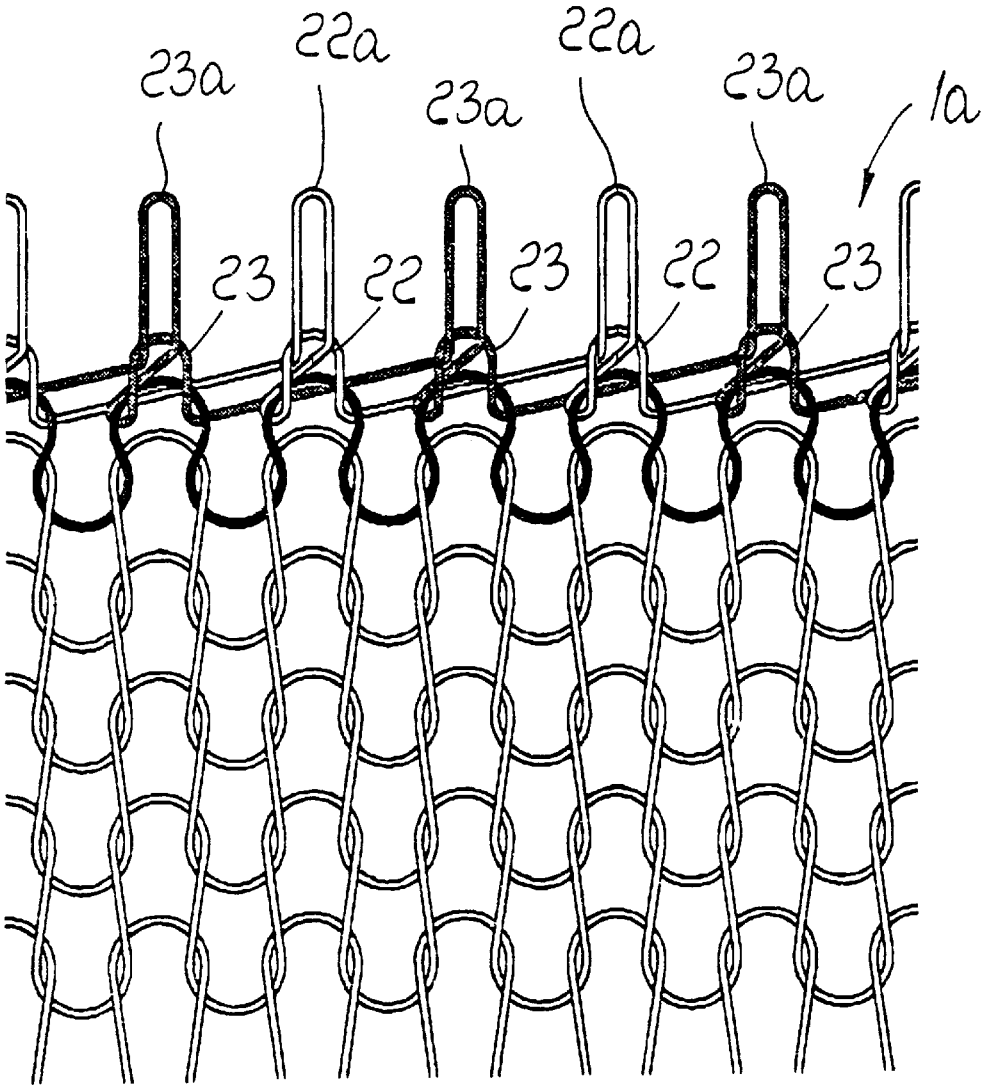

As an alternative, as shown in FIGS. 7 and 8, the last row of knitting, designated by the reference numeral 1*a* in these figures, can be provided by knitting first loops 22 with a first set of needles and alternating them with second loops 23 formed with a second set of needles which are alternated with the needles of the first set of needles, and by providing interstitch portions 22*a* between the loops 22 and interstitch portions 23*a* between the loops 23. In this case, too, the interstitch portions 22*a* and 23*a* are provided with an increased length, so as to constitute additional loops.

Conveniently, the first loops 22 are then knit in with the first additional loops 22*a*, whilst the second loops 23 are then knit in with the second additional loops 23*a*, obtaining an item as shown in FIG. 8.

FIG. 7 shows how it is possible to obtain the interstitch portions 22*a* and 23*a*, which have an increased length, by resting the thread or threads used to form the last row on the tips 11*a* of the hooks.

In this case, the last row 1*a* of the item can be formed for example by feeding a thread, at one feed of the machine, to the needles of the first set of needles and by then feeding the same thread, at the following turn of the needle cylinder about its own axis, to the second set of needles.

The meshing of the loops 22 and 23 with the additional loops 22*a* and 23*a* can be performed on a circular knitting machine or hosiery-making machine with a cylinder and a circular plate, in a manner which is similar to the one described with reference to FIGS. 3 to 6, by offsetting the circular plate of the machine with respect to the needle cylinder, so as to place the hooks at the needles that pick up the additional loops formed by the interstitch portions 22*a* and 23*a*, passing them through the loops 22 and 23 which are dropped by the needles.

Figure 9:
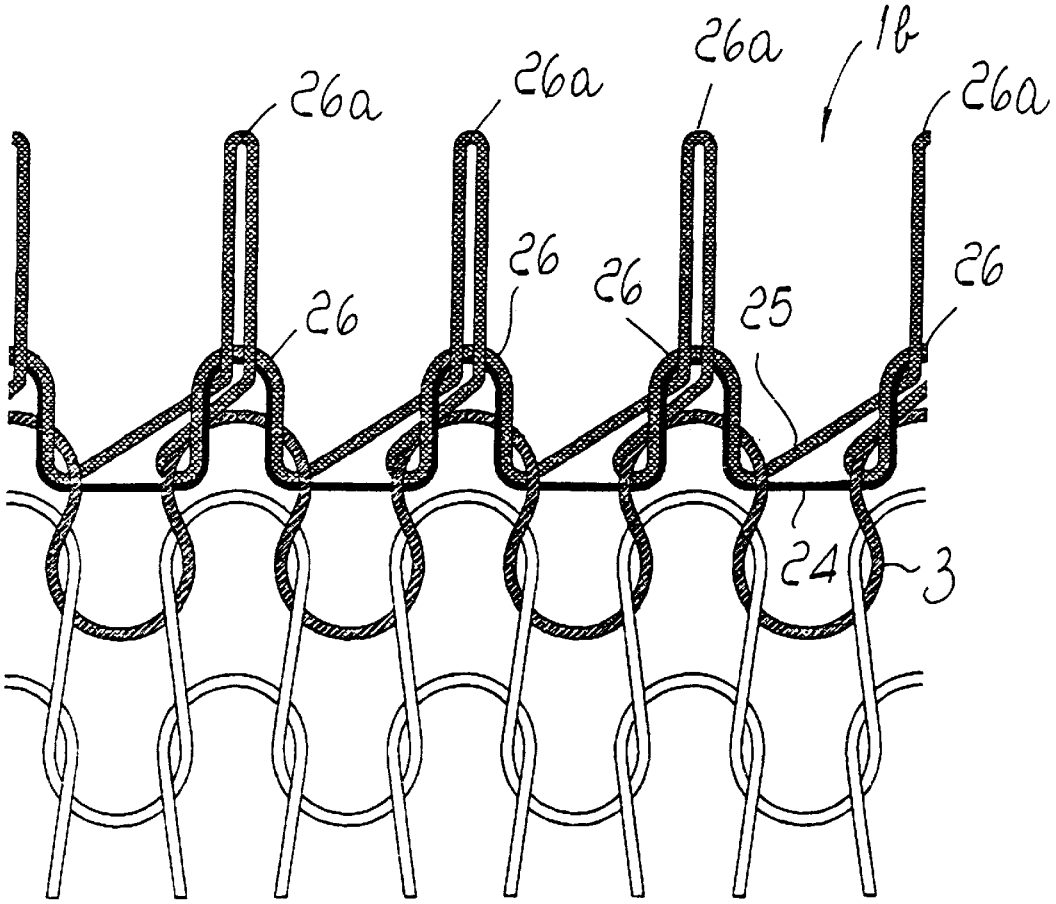
FIG. 9 is a view of the end portion of a knitted item produced according to still another different embodiment of the method according to the invention.

In the different embodiment shown in FIG. 9, the last row of knitting, designated by the reference numeral 1*b*, is produced with two threads: a first thread 24, which is preferably elastic, and a second thread 25. In this case, the additional loops 26*a* are formed only with the second thread 25, and the loops 26 of the last row, formed by the first thread 24 and the second thread 25, are knit in with the additional loops 26*a* formed with the second thread 25. The operating procedure for performing this embodiment is similar to the one described with reference to FIGS. 3 to 6, except that only the second thread 25 is rested on the tips 11*a* of the hooks 11.

The item obtained with the method according to the present invention has an excellent finish degree, even at the last row of knitting 1, 1*a*, 1*b*, which is fully acceptable from an aesthetic point of view.

Thanks to the fact that the interstitch portions of the last row are longer and form additional loops 2*a*, 22*a*, 23*a*, 26*a*, and to the fact that the loops of knitting 2, 22, 23, 26 of the last row are preferably knit in with the additional loops of knitting 2*a*, 22*a*, 23*a*, 26*a*, high resistance is achieved not only to accidental laddering but also to laddering in the presence of a rather high tension applied to the thread or threads that compose said last row of knitting.

It should be noted that the method according to the present invention has been studied particularly to allow manufacture of hosiery items on single-cylinder stocking machines with conventional processes, starting from the toe of the hosiery item instead of from the cuff or top; with conventional methods, these operations necessarily leave the last formed row of knitting, which corresponds to the upper end of the leg of the hosiery item, in a condition in which it must be subjected to a subsequent sewing or looping operation to prevent it from laddering.

In practice, it has been observed that the method according to the invention fully achieves the intended aim and objects, since it allows to produce knitted items in which the last row is highly ladderproof, thus avoiding the need to subject the item to subsequent sewing or looping operations, with a consequent saving in terms of production costs.

The method thus conceived is susceptible of numerous modifications and variations, all of which are within the scope of the inventive concept; furthermore all the details may be replaced with other technically equivalent elements.

In practice, the materials employed, so long as they are compatible with the specific use, as well as the dimensions, may be any according to requirements and to the state of the art.

What is claimed is:

1. A method for ladderproofing a last row of a knitted item, comprising:

forming a next-to-last row of the knitted item by forming loops of knitting of said next-to-last row which are mutually and successively interjoined by interstitch portions of said next-to-last row;

forming the last row of the knitted item by forming loops of knitting of said last row which are mutually and successively interjoined by interstitch portions of said last row and connecting said last row to said next-to-last row by connecting respective interstitch portions of said last row between respective mutually adjacent loops of knitting of said next-to-last row;

forming the interstitch portions of said last row with an increased length with respect to a length of the interstitch portions of said next-to-last row;

forming the increased length interstitch portions of said last row into additional loops which are arranged between respective adjacent loops of knitting of the last row; and knitting each one of said additional loops of said last row into a respective adjacent loop of knitting of said last row by inserting said each one of said additional loops into said respective adjacent loop of knitting.

2. The method of claim 1, wherein said next-to-last row of knitting is produced with at least one pretensioned elastic thread.

3. The method of claim 1, comprising:

providing a first and a second set of knitting needles;

forming first loops of said loops of knitting of said last row mutually interjoined by first interstitch portions with said first set of needles;

forming, alternated with said first loops, second loops of said loops of knitting of said last row mutually interjoined by second interstitch portions with said second set of needles which are alternated with needles of said first set of needles;

forming first additional loops from said first interstitch portions;

forming second additional loops alternated with said first additional loops from said second interstitch portions;

knitting each one of said first additional loops into a respective adjacent loop of said first loops by inserting said each one of said first additional loops into said respective adjacent loop of said first loops; and knitting each one of said second additional loops into a respective adjacent loop of said second loops by inserting said each one of said second additional loops into said respective adjacent loop of said second loops.

4. The method of claim 1, comprising:

forming said last row with a first thread and a second thread;

forming said additional loops only with said second thread;

forming said loops of said last row, with said first and second threads; and knitting each one of said additional loops formed with said second thread into respective adjacent loops of said last row.

5. The method of claim 4, wherein said first thread is provided as an elastic thread.

6. A knitted item formed with knitted thread comprising:

a next-to-last row of the knitted item having loops of knitting of said next-to-last row which are mutually and successively interjoined by interstitch portions of said next-to-last row a last row of knitting of the knitted item having loops of knitting of said last row which are mutually and successively interjoined by interstitch portions of said last row, said last row being connected to said next-to-last row by said last row having respective interstitch portions of said last row connected between respective mutually adjacent loops of knitting of said next-to-last row, the interstitch portions of said last row having an increased length with respect to a length of the interstitch portions of said next-to-last row;

additional loops which are formed from the increased length interstitch portions of said last row and which are arranged between respective adjacent loops of knitting of the last row, each one of said additional loops of said last row being knit into a respective adjacent loop of knitting of said last row by being inserted into said respective adjacent loop of knitting.

7. The knitted item of claim 4, wherein said next-to-last row of knitting is formed with at least one pretensioned elastic thread.

8. The knitted item of claim 6, formed with a first and a second set of knitting needles comprising:

first loops of said loops of knitting of said last row mutually interjoined by first interstitch portions produced by said first set of needles;

second loops, alternated with said first loops, of said loops of knitting of said last row mutually interjoined by second interstitch portions formed with said second set of needles which are alternated with needles of said first set of needles;

first additional loops formed from said first interstitch portions;

second additional loops alternated with said first additional loops and formed from said second interstitch portions;

each one of said first additional loops being knit into a respective adjacent loop of said first loops by being inserted into said respective adjacent loop of said first loops; and each one of said second additional loops being knit into a respective adjacent loop of said second loops by being inserted into said respective adjacent loop of said second loops.

9. The knitted item of claim 6, said last row being formed with a first thread and a second thread, said additional loops being formed only with said second thread, said loops of said last row being formed by said first thread and said second thread, and each one of said additional loops being knit into respective adjacent loops of said last row.

10. The knitted item of claim 9, wherein said first thread is constituted by an elastic thread.

* * * * *